US005857773A

United States Patent [19]

Tammelin

[11] Patent Number: 5,857,773

[45] Date of Patent: Jan. 12, 1999

[54] POLYMER DISSOLVING METHOD AND APPARATUS

[75] Inventor: Heikki Antero Tammelin, Raisio, Finland

[73] Assignee: Turun Asennusteam Oy, Masku, Finland

[21] Appl. No.: 836,216

[22] PCT Filed: Nov. 13, 1995

[86] PCT No.: PCT/FI95/00620

§ 371 Date: May 7, 1997

§ 102(e) Date: May 7, 1997

[87] PCT Pub. No.: WO96/14923

PCT Pub. Date: May 23, 1996

[30] Foreign Application Priority Data

Nov. 15, 1994 [FI] Finland ..... 945374

[51] Int. Cl.[6] ..... B01F 15/02

[52] U.S. Cl. ..... 366/178.1; 366/163.2

[58] Field of Search ..... 366/101, 102, 366/137.1, 177.1, 178.1, 178.3, 163.1, 163.2, 176.1, 191, 341; 422/224, 901; 528/499; 261/78.1

[56] References Cited

U.S. PATENT DOCUMENTS

| | | | |
|---|---|---|---|
| 3,298,669 | 1/1967 | Zingg | 366/178.1 |
| 4,050,677 | 9/1977 | Benthin | 366/101 |
| 4,077,612 | 3/1978 | Ricciardi | 366/102 |
| 4,340,429 | 7/1982 | Mayer | 106/164 |
| 4,643,582 | 2/1987 | Ricciardi | 366/178.1 |
| 4,688,945 | 8/1987 | Brazelton et al. | 366/178.1 |
| 4,845,192 | 7/1989 | Sortwell et al. | 366/102 |
| 5,171,090 | 12/1992 | Wiemers | 366/163.2 |

FOREIGN PATENT DOCUMENTS

| | | |
|---|---|---|
| 0100963 | 7/1983 | European Pat. Off. . |
| 0303907 | 8/1988 | European Pat. Off. . |
| 0365831 | 9/1989 | European Pat. Off. . |
| 3228843 | 8/1993 | Germany . |
| 659003 | 11/1982 | Switzerland . |
| 1563588 | 3/1977 | United Kingdom . |

*Primary Examiner*—Tony G. Soohoo
*Attorney, Agent, or Firm*—Ladas & Parry

[57] ABSTRACT

The invention relates to a polymer dissolving method and apparatus, which method is entirely or partly based on a pressurized method, in which mixing is carried out in a dissolving head (3) by means of mechanical or static mixers (7, 11, 12). At the end of the process there are pressure chambers (9, 10) wherein pressure is maintained by means of a feed pump (8) and a valve (25). The process is entirely or partially pressurized.

11 Claims, 1 Drawing Sheet

POLYMER DISSOLVING METHOD AND APPARATUS

The present invention relates to a method for dissolving polymers or the like in water, and an apparatus for implementing this method. In the dissolving of polymers, water, air, mechanical mixers and superatmospheric pressure for "overpressure" are utilized.

A heavy increase has taken place in the use of water-soluble polymers for various kinds of purposes. As a result, polymers are used to an increasing extent for different kinds of environmental protection purposes as well as for clarifying various types of solutions. Polymers and solutions thereof, mainly aqueous solutions, are also utilized in chemical and paper industries.

Different types of polymers are usually packed and stored as powder. As they are usually used as an aqueous solution, different kinds of apparatuses and methods have been developed for their mixing. The methods most commonly employed are based on batch production. This means that water is first delivered into a container, and the polymer powder is mixed in the water by mechanical mixers or similar devices. The reason why methods and apparatuses of the batch principle have been used is a consequence of slow dissolution of polymers, and, in addition, the aim for a tender mixing process and saving long polymer chains.

Finnish patent application 851 185 discloses an apparatus and a method for mixing polymers in water. For a fast mixing of polymers and water, the solution is fed to a grinder type of a device which causes effectively shearing conditions for decreasing the particle size. U.S. Pat. No. 4,778,280 discloses a polymer mixing method which utilizes a centrifugal pump for carrying out the mixing. However, practice has shown that a proper enough mixing of polymers in water cannot be achieved by mechanical apparatuses alone.

It is an object of the method and apparatus of the present invention to provide a simple and continuous device in which the production of a solution of polymers and water partly takes place under pressure.

The polymer dissolving method and apparatus according to the invention are characterized by that which is set forth in the attached claims.

The quality and properties of a product produced by the method according to the invention will be considerably improved. A stepless control of the process is possible. Furthermore, the space the apparatuses require is decreased as a result of the continuous process. Due to the simplicity of the method, reliable operation of the control system is achieved.

In the following, the invention will be described in closer detail with reference to the accompanying drawings.

Figure 1:
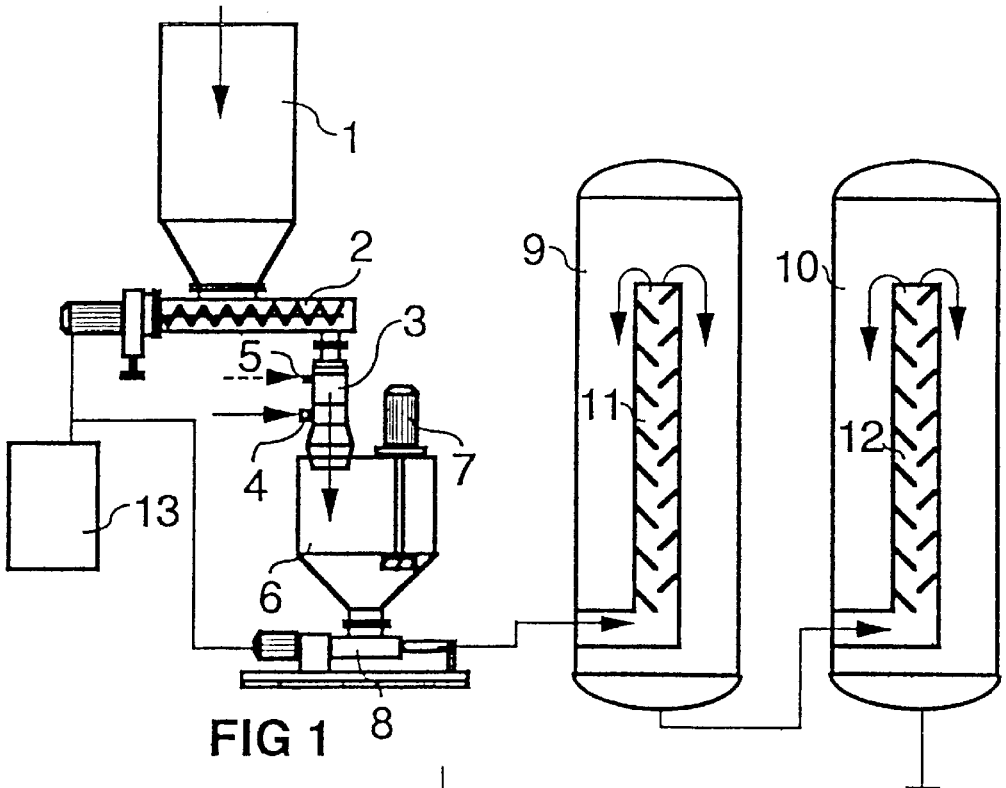
FIG. 1 is a schematic representation of an embodiment according to the method of the invention.
Figure 2:
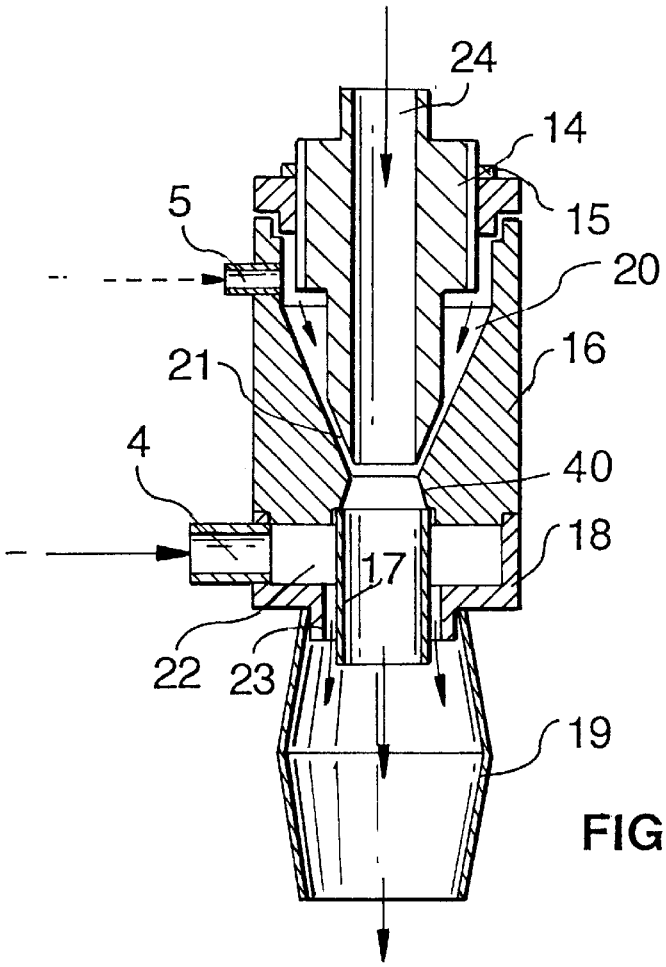
FIG. 2 shows a cross section of a polymer powder dissolving head.

Referring to FIG. 1, number 1 indicates a container of powdered polymer. Number 2 refers to a batch feeder, and number 3 to a dissolving head. A water inlet with its valves is indicated by number 4, and an air inlet by number 5. Number 6 indicates a premixing tank, and number 7 a mixer. A feed pump, also used for pressure rising, is marked with number 8, pressure chambers with numbers 9 and 10, and static mixers therein with numbers 11 and 12. A frequency converter, used for adjusting the batch feeder 2 and the feed pump 8, is indicated by number 13. FIG. 2 illustrates a cross section of the dissolving head 3, and the air and water inlets therein by numbers 5 and 4, respectively. Number 14 indicates a nozzle, and number 15 a locking ring. The chassis is marked with number 16, and an acceleration tube with number 17. A water chamber attached to the chassis 16 is indicated by number 18, and a mixing chamber by number 19. An annular feed space for air is indicated by number 20, and feed ducts by number 21. These ducts 21 inject air peripherally adjacent the downstream end of the feed tube 24 at an angle having a substantial component with respect to the longitudinal axis of said feed tube 24. Number 22 refers to a water chamber, and number 23 to a water feed duct. Number 24 indicates a polymer feed line. The pressure of the entire system is controlled by means of valve 25.

The dissolving method for polymers and the apparatus used therein is activated as follows. The batch feeder 2 activates the feeding of polymer to the dissolving head 3. Upon commencing the feeding of the solution, the feed pump 8 is also started, by which is it possible to meter the amount of the solution delivered for consumption at any one time. From the container 1, the batch feeder 2 meters a desired amount of polymer to the dissolving head 3, wherein negative pressure prevails in the polymer feed line or internal bore 24, to which an ejector effect can be achieved by pumping air under pressure to the annular space 20 whereby the air is throttled and the flow rate increases in the feed ducts 21. The flow of air directed peripherally adjacent the downstream end of the feed line 24, through a transitional frusto-conical zone 40, and then into the acceleration tube or zone 17, which has a greater internal cross-section than that of the internal bore 24, creates a negative pressure which communicates with the polymer feed line 24. The expanding air accelerates the flow rate of the polymer and air mixture in the acceleration tube 17, from the outside of which water is fed peripherally adjacent the downstream end of acceleration tube 17 from the annular space 22 through duct 23 to the mixing chamber or zone 19 where the actual mixing takes place, which mixing zone 19 has a greater internal cross-section than that of the acceleration zone 17. The premixing tank 6 is under normal atmospheric pressure, and in order to improve dissolving it may be equipped with a mechanical mixer 7. From the premixing tank 6, a desired amount of solution is delivered for the process to the pressure chambers 9 and 10, which are equipped with static mixers 11 and 12. Within the pressure chambers 9 and 10, the desired superatmospheric pressure is maintained simply by means of the pressure control valve 25 and the feed pump 8. The mixer 7 in the premixing tank 6 may be kept on permanently, and the feeding into the premixing tank may take place, for example, by high and low limiting control, which activate and stem the air and water feed to the polymer powder dissolving head 3, and the powder feed to the batch feeder from the polymer container 1. The pressure chambers 10 and 11 function as curing reactors improving and speeding up the dissolving of polymers in water. The number of containers may vary depending on the pressure of the process and the consumption requirements. As shown, the longitudinal axis extending through the internal bore 24 of the mixing head 3 as well as through the acceleration tube 17 and the mixing chamber 19 is substantially vertical with the mixing chamber 19 positioned over the premixing tank 6.

It is obvious that the aforementioned presents but one embodiment of the idea of the invention. The number and size of pressure chambers 10 and 11 may vary broadly, and they can also be supplied with mechanical rotating mixers, or the like. The implementation of the polymer powder dissolving head 3 may also be different than described above. Therefore, the polymer powder may be delivered to the premixing tank either by means of water or air. It is also possible to feed the powder directly into the premixing tank 6.

I claim:

1. A method for dissolving a polymer or the like in water, which method comprises:

supplying powdered polymer to an interior bore of a dissolving head, said interior bore communicating with an acceleration zone disposed along a longitudinal axis extending through and beyond said interior bore, said acceleration zone having a greater internal cross-section than that of the internal bore, supplying air under pressure peripherally adjacent the downstream end of the internal bore and into the acceleration zone so as to establish a negative pressure pulling powder from the internal bore into the acceleration zone together with said air supplied under pressure, communicating the acceleration zone with a mixing zone along said longitudinal axis, said mixing zone having a greater internal cross-section than that of the acceleration zone, introducing water peripherally adjacent the downstream end of the acceleration zone so as to wet the polymer powder suspended in air exiting the acceleration zone, and directing the powdered polymer, water and air from the mixing zone into a premixing tank, and pumping a slurry of the powdered polymer in water which accumulates in the premixing tank to at least one mixing tank, and maintaining a desired superatmospheric pressure in the at least one mixing tank.

2. A method according to claim 1, in which the air under pressure is supplied peripherally adjacent the downstream end of the interior bore and into the acceleration zone at an angle having a substantial component parallel to the longitudinal axis of the interior bore.

3. A method according to claim 1, wherein the longitudinal axis is substantially vertical and the powder, water and air from the mixing zone move in a downward direction.

4. A method according to claim 1, in which the slurry is passed in contact with static filters in the at least one mixing tank maintained under pressure.

5. A method according to claim 1, in which mixing carried out in the premixing tank with a mechanical mixer.

6. An apparatus for dissolving a polymer or the like in water, which apparatus comprises:

a storage container for powdered polymer, a dissolving head, an air inlet communicating with the dissolving head, a water inlet communicating with the dissolving head, a batch feeder supplying powdered polymer from the storage container to the dissolving head, a premixing tank positioned to receive powdered polymer, water and air from the dissolving head, at least one mixing tank for receiving a slurry of water and powdered polymer from the premixing tank, and a feed pump for supplying slurry formed from accumulated powdered polymer and water in the premixing tank to the at least one mixing tank, said mixing tank being adapted to be maintained under superatmospheric pressure, said dissolving head having an interior bore for receiving the powdered polymer, an acceleration zone of greater internal cross-section than that of the interior bore and communicating with and extending along a longitudinal axis of said interior bore extending therefrom, ducts for receiving air under pressure from said air inlet and supplying said air peripherally adjacent the downstream end of the internal bore and in the direction of the acceleration zone, and a mixing zone communicating with and extending further downstream of the acceleration zone and also extending along the longitudinal axis of the internal bore, said mixing zone having a greater internal cross-section than that of the acceleration zone and being positioned over said premixing tank to discharge the powdered polymer, water and air thereto, said water inlet means communicating with duct means adjacent the periphery of the downstream end of the acceleration zone so as to supply the water to said mixing zone.

7. An apparatus according to claim 6, wherein the at least one mixing tank includes static filters positioned so that the slurry pumped to the at least one mixing tank passes in contact with said static filters.

8. An apparatus according to claim 6, which includes an outlet valve for controlling the pressure in the at least one mixing tank.

9. An apparatus according to claim 6, which includes a mechanical mixer in the premixing tank.

10. An apparatus according to claim 6, in which the longitudinal axis extending through the interior bore, the acceleration zone and the mixing zone is substantially vertical and said mixing zone is positioned over the premixing tank.

11. An apparatus according to claim 6, which includes a frusto-conical transition zone positioned between the interior bore and the acceleration zone, the ducts supplying the air through the frusto-conical zone before said air enters the mixing zone.

* * * * *